United States Patent [19]

Stumpp et al.

[11] Patent Number: 4,727,848

[45] Date of Patent: Mar. 1, 1988

[54] DEVICE FOR AND METHOD OF SUPPLYING CASES INTO A COMBUSTION SPACE OF A SELF-IGNITING INTERNAL COMBUSTION ENGINE

[75] Inventors: Gerhard Stumpp, Stuttgart; Wolf Wessel, Oberriexingen, both of Fed. Rep. of Germany

[73] Assignee: Robert Bosch GmbH, Stuttgart, Fed. Rep. of Germany

[21] Appl. No.: 81,523

[22] Filed: Aug. 3, 1987

Related U.S. Application Data

[63] Continuation of Ser. No. 763,356, Aug. 7, 1985, abandoned.

[30] Foreign Application Priority Data

Aug. 14, 1984 [DE] Fed. Rep. of Germany ..... 3429909
Dec. 8, 1984 [DE] Fed. Rep. of Germany ..... 3444877

[51] Int. Cl.[4] ..... F02M 25/06

[52] U.S. Cl. ..... 123/569; 123/571; 123/378

[58] Field of Search ..... 123/376, 378, 569, 571, 123/568, 382, 401, 403; 60/278, 311

[56] References Cited

U.S. PATENT DOCUMENTS

| | | | |
|---|---|---|---|
| 4,388,909 | 6/1983 | Ogasawara et al. | 123/571 X |
| 4,401,078 | 8/1983 | Kato et al. | 123/378 X |
| 4,433,666 | 2/1984 | Masaki et al. | 123/569 |
| 4,446,840 | 5/1984 | Nakagawa et al. | 123/569 X |
| 4,450,824 | 5/1984 | Ando et al. | 123/569 |
| 4,452,217 | 6/1984 | Kawamura et al. | 123/569 X |
| 4,463,721 | 8/1984 | Hayashi et al. | 123/378 |
| 4,466,416 | 8/1984 | Kawamura | 123/569 X |
| 4,471,611 | 9/1984 | Watanabe | 60/311 X |
| 4,624,228 | 11/1986 | Sahara et al. | 123/569 X |

FOREIGN PATENT DOCUMENTS

| | | | |
|---|---|---|---|
| 0026256 | 2/1982 | Japan | 123/569 |
| 0110758 | 7/1982 | Japan | 123/569 |

*Primary Examiner*—Willis R. Wolfe
*Attorney, Agent, or Firm*—Michael J. Striker

[57] ABSTRACT

A controlling device for controlling the supply of gases into combustion spaces of a self-igniting internal combustion engine includes a control member for regulating the flow of returned exhaust gas and an air throttle for regulating flow of sucked in air. The air throttle and the control member are linked to pneumatic setting motors which in turn are controlled by pressure transforming means operating with a source of a reference pressure and a source of control pressure. An output of the pressure transforming means is provided with electrically controlled switching means which selectively actuate respective setting motors. The electric control of the pressure transforming means and of the connecting means is made in dependency on operational variables of the engine.

21 Claims, 5 Drawing Figures

DEVICE FOR AND METHOD OF SUPPLYING CASES INTO A COMBUSTION SPACE OF A SELF-IGNITING INTERNAL COMBUSTION ENGINE

This application is a continuation of application Ser. No. 763,356, filed Aug. 7, 1985, now abandoned.

BACKGROUND OF THE INVENTION

The present invention relates in general to a device for controlling the supply of air and recycled exhaust gas components into combustion spaces of a self-igniting internal combustion engine and also relates to a method of controlling the supply of such gas components.

In prior art devices of this kind, known for example from U.S. Pat. No. 4,177,777, air sucked in by the engine is metered by an air flow sensor and a control signal indicative of the intake air flow and if desired of other operational parameters of the engine, changes control pressure in a pneumatically operated valve in a return conduit for exhaust gas, thus controlling the quantity of returned exhaust gas components.

In another prior art controlling device of this kind known from U.S. Pat. No. 4,467,775 the control of the amount of the returned exhaust gas is effected according to the deviation of the actual value of the supplied air quantity from a desired air flow value which is determined from operational variables of the engine, particularly from the load. The correction of the actual air flow occurs by changing the quantity of the returned exhaust gas at free suction of air by the engine. The actuation of a control member for the returned exhaust gas is made by means of a pneumatic pressure medium supplied through a pressure transforming device in a control pressure chamber of a setting motor. The pressure transformer in this known controlling device consists of two solenoid controlled 2/2 directional control valves which selectively connect the control pressure space of the setting motor either with outer atmosphere acting as a reference pressure source or with a source of vacuum or low pressure. The actuation of the solenoids of the directional control valve can be made either by an analog or a digitial signal.

This known controlling device adjusts accurately only the quantity of the fed back exhaust gas so as to achieve an optimum combustion at a high rate of exhaust gas recycling, and to reduce emission of $NO_x$ pollutants. At a given engine load or quantity of supplied fuel, the fuel-air ratio is accurately preserved through the control of the fresh air flow by means of the returned exhaust gas control and consequently the proportion of HC and CO pollutants as well as soot or carbon deposit in exhaust gas is kept low.

In the case of self-igniting internal combustion engines however such prior art controlling devices do not meet all operational requirements. In particular, when no special measures are taken, a self-igniting internal combustion engine produces an increased quantity of soot in exhaust gas and care mus be taken that the excessive soot does not reach free atmosphere.

SUMMARY OF THE INVENTION

It is therefore a general object of the present invention to overcome the disadvantages of prior art controlling devices of this kind.

More particularly, it is an object of this invention to provide an improved device for and a method of controlling the sucked in air in dependency on operational variables of an internal combustion engine even at those modes of operation of the latter at which no exhaust gas feedback takes place.

Another object of this invention is to control the supply of gases in the combustion spaces of the engine in such a manner as to reduce noise during idling mode of operation and to make the idling stable.

Still another object of this invention is to increase temperature of exhaust gas in order to burn out soot accumulated in a soot filter arranged in the exhaust gas system.

An additional object of this invention is to enable an immediate stoppage of the engine.

In keeping with these objects and others which will become apparent hereafter, one feature of the invention resides, in a controlling device of the aforedescribed type including an air intake system and an exhaust gas collection system communicating with the latter via a return conduit, in a combination which includes a control member arranged between the return conduit and the air intake system, the control member being normally in its closing position interrupting communication between the air intake and exhaust gas collection systems, a first pressure actuated setting motor including a control pressure chamber and a reference pressure chamber separated from the latter by a movable wall, the wall being connected to the control member, a first and a second source of pressure medium, the first source communicating via an electrically controlled pressure transformer with the first pressure control chamber, the second pressure source being at atmospheric pressure, an electronic control circuit generating a control signal indicative of operational variables of the engine, particularly a quantity of sucked-in air and quantity of supplied fuel, the control signal being applied to the pressure transformer, the air intake system including an air throttle normally biased into its open position, a second pressure activated setting motor including a control pressure chamber and a reference pressure chamber communicating with the intake system upstream of the air throttle, the wall of the second setting motor being coupled to the air throttle to control working position of the same and the control pressure chamber of the second setting motor being normally connected to the second pressure source.

In a preferred embodiment of this invention, the first and the second setting motors are supplied with pressure medium delivered through a single pressure transformer whereby a solenoid controlled directional control valve is interconnected between the pressure transformer and the setting motors.

In a modification, a solenoid controlled 3/2 directional control valve is connected between the pressure transformer and the first setting motor, the valve connecting in one position thereof the setting motor to the outer atmosphere and in another position to the pressure transformer. The second setting motor remains connected to the pressure transformer and consequently the sucked-in air is controlled even at those operational conditions at which no exhaust gas is returned. By virtue of the air throttle the control of the returned exhaust gas is stabilized and requisite pressure difference at the control member for the returned exhaust gas is affected so as to achieve an exact rate of the exhaust gas return.

The novel features which are considered as characteristic for the invention are set forth in particular in the appended claims. The invention itself, however, both as to its construction and its mode of operation, will be best understood from the following description of specific embodiments when viewed in connection with the accompanying drawings.

DESCRIPTION OF THE PREFERRED EMBODIMENTS

Figure 1:
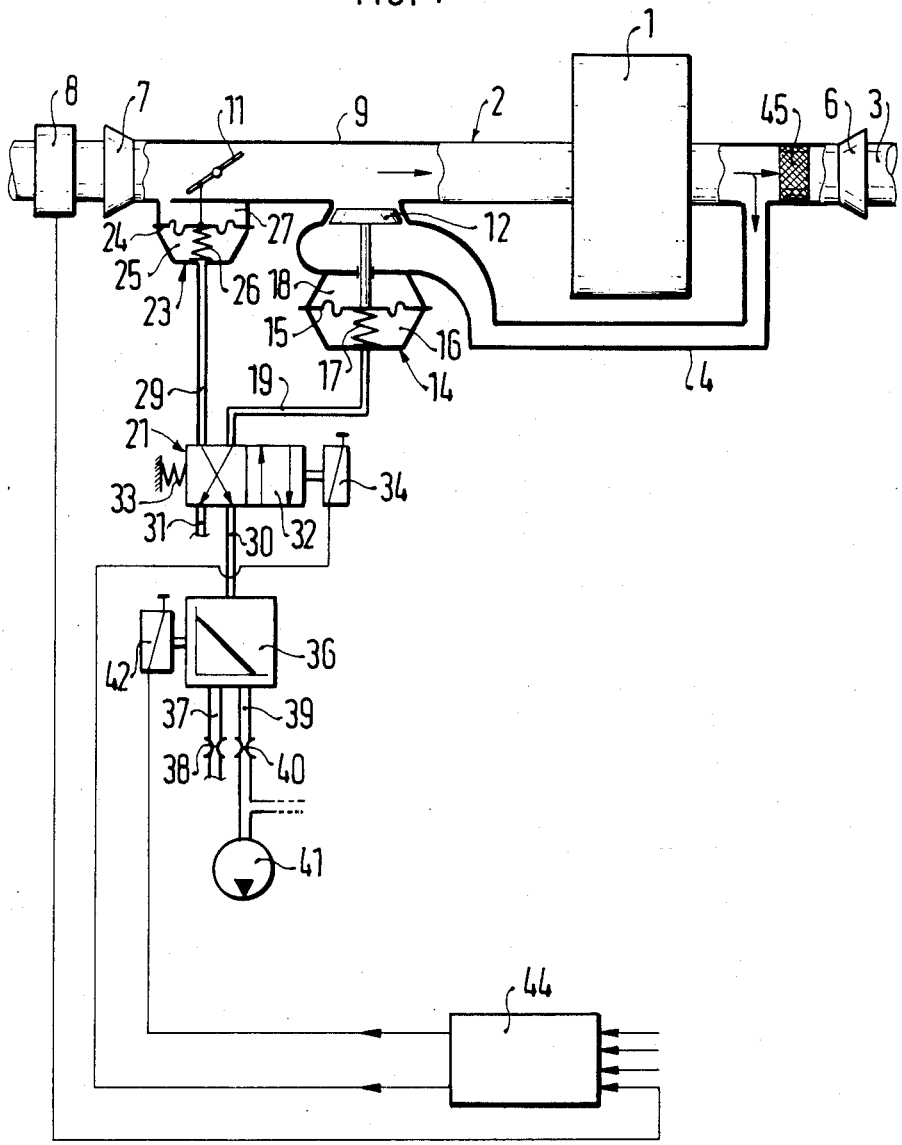
FIG. 1 is a schematic illustration of a first embodiment of the controlling device of this invention employing only a single pressure transformer and an electrically controlled directional control valve.

Referring firstly to FIG. 1 a self-igniting internal combustion engine 1 is provided with an air intake system 2 and with an exhaust gas collecting system 3. A return conduit 4 connects the system 3 with the intake tube 9 of the system 2. The intake tube 9 is part of a non-illustrated air intake manifold. The engine 1 can operate with supercharging, for example by means of exhaust gas turbo supercharger whereby an exhaust gas turbine 6 is installed in the exhaust gas collecting system 3 while an air compressor 7 is installed in the air intake system 2 and driven by the turbine 6. An air flow sensor 8 is arranged at the inlet of the air intake system 2 upstream of the opening of the exhaust gas return conduit 4 in the tube 9. The sensor 8 can be arranged before or after the air compressor 7. A throttling organ, for example in the form of an air throttle 11 is arranged in the intake tube 9 upstream of the opening of the return conduit 4 so as to change the suction cross-section of the intake pipe and hence to change the quantity of air flowing into combustion spaces of the engine 1.

A control member 12, in the form of a poppet valve is arranged in the opening of the exhaust gas return conduit 4 into the intake pipe 9. The control member 12 which can be also of a different construction than illustrated, is connected to a movable wall 15 of a first setting motor 14. The wall 15 which in this example is in the form of a setting diaphragm secured to the inner wall of the housing of the setting motor, delimits a control pressure space 16 at one side and a reference pressure space 18 at the opposite side. Control pressure space 16 houses a biasing spring 17 urging through the diaphragm the control member 12 into its closing position. The reference pressure chamber 18 communicates with ambient atmosphere whereas the control pressure space 16 is connected via conduit 19 with a port of an electrically controlled directional control valve 21.

The air throttle 11 is controlled by a second setting motor 23 of similar construction as the first setting motor. For this purpose, the air throttle which in this example is in the form of a valve plate, is linked to the movable wall or diaphragm 24 of the second motor 23. The diaphragm separates the housing of the motor 23 into a control pressure chamber 25 which communicates via a conduit 29 with another port of the directional control valve 21. The control pressure chamber 25 houses a biasing spring 26 which urges via the diaphragm 24 the air throttle 11 into its normally open position. The other side of the movable wall or diaphragm 24 delimits reference pressure chamber 27 which communicates through the inlet part of tube 9 with the outer atmosphere.

The electrically controlled directional control valve 21 has, apart from the first mentioned two ports, a third port connected to a conduit 30 and a fourth port connected to a connection piece 31 which is connected to a source of reference pressure which in this example is the atmospheric pressure of ambient air. The electrically controlled directional control valve has a sliding spool 32 which is biased by a spring 33 into a rest position in which the intake conduit 29 of the second setting motor 23 is connected to the conduit 30 for supplying a pressure medium, and venting conduit 31 is connected to the intake conduit 19 for the first setting motor 14. Upon actuation of a solenoid 34 by a control signal from an electric control circuit 44, the spool 32 is displaced into its activated position against the force of biasing spring 33. The actuation of the valve 21 can occur also in different ways conventional in the art, for example, by means of servo motors. In the actuated position of the valve control pressure chamber 25 of the second setting motor is connected with the second pressure source (ambient atmosphere) and the control pressure space 16 of the first setting motor is connected with a conduit 30.

The conduit 30 leads to an electrically controlled pressure transformer 36 which can be for example in the form of a 3/2 directional control valve or in the form of two 2/2 directional control valves, or a proportional control valve. The pressure transformers of this kind are well known in the art, for example from the beforementioned U.S. Pat. No. 4,467,775 or from the U.S. Pat. No. 4,177,777 and need not be described in detail. In general, the electrically controlled pressure transformer 36, which in this example is an electropneumatic converter (EPW) has an output port which is connected to the supply conduit 30, a reference pressure port 37 connected if desired through a throttle 38 with a second source of pressure medium (ambient air), and a port 39 connected through a second throttle 40 to the first source of pressure medium 41 which may be in the form of a vacuum pump. An actuating member 42 such as a solenoid for the pressure transformer 36, is connected to an output of the electric control circuit 44 which from a predetermined number of sensed engine variables such as rotary speed, fuel dosing and air intake produces after evaluation a corresponding control signal which is applied to the actuator 42. The actuator can be controlled, for example, intermittently by pulses of variable width so that ports 37 and 39 are alternately connected to the output conduit 30. In a modification, the control of the actuating member 42 can be effected by an analog signal changing the cross-section of ports 37 and 39. In the drawing the block indicating the pressure transformer 36 is provided with a characteristic of the transformer showing the behavior of supplied underpressure $p_u$ in response to the applied control signal. It will be seen that when no signal is applied to the actuator 42, full underpressure $p_u$ passes from the intake port 39 to the output conduit 30 while the port 37 is closed. When the highest control signal is applied to the transformer then the port 37 leading to the second reference pressure source is continuously opened and the port 39 leading to the control pressure source 41 is closed. By means of throttles 38 and 40 the course the functional characteristic can be adjusted.

As mentioned before, the electrical control circuit 44 controls also the solenoid 34 of the directional control valve 21. The circuit 44 has a plurality of inputs indicated by arrows which are connected, apart to the air flow sensor 8, to non-illustrated sensors of additional operational parameters of the engine. The circuit 44 is designed such as to distinguish between two operational conditions, namely between a first operational condition in which exhaust gas is fed back (ARF) and a second operational condition in which the exhaust gas return is interrupted. The second condition corresponds, among others, to idling of the engine during which burning of soot filters 45 or stopping of the engine is necessary. The distinguishing capability of the circuit 44 can be achieved for example by load signal or by a signal corresponding to fuel quantity supplied to the engine or to other operational variables such as pressure drop across the soot filter 45.

In the position of the directional control valve 21 illustrated in FIG. 1, the engine is in the above described second operational condition. Upon energization of solenoid 34, the control spool 32 of the valve 21 is displaced against the biasing spring 33 and intake conduit 19 of the first setting motor is connected to the conduit 30. The intake conduit 29 of the second setting motor is connected to the venting connection piece 31. Accordingly, control pressure space 25 of the second setting motor 23 is under atmospheric pressure. Since the same atmospheric pressure is also in the reference pressure chamber 27, the biasing spring 26 displaces the air throttle 11 into its fully open position. The control pressure chamber 16 of the first setting motor 14 however is attacked by variable control pressure delivered from the pressure transformer 36. As a consequence, the engine sucks in both air and controlled amounts of returned exhaust gas whereby by means of the exhaust gas quantity control the proportion of air admitted into combustion spaces of the engine is also changed. From the air flow signal generated by sensor 8 and from a signal indicative of the amount of supplied fuel, the circuit 44 delivers a control signal which in the abovedescribed manner changes the rate of the exhaust gas return and hence adjusts certain fuelair ratio. The engine operates continuously with complete loading whereby maximum quantities of exhaust gas can be fed back inasmuch residual charge with exhaust gas takes place in the combustion spaces. As known, the recycling of exhaust gases causes a drop of peak temperatures in the combustion spaces and consequently a reduction of emission of components $NO_x$ in the exhaust gas. By means of stored characteric fields and access parameters to these fields, such as rotary speed, quantity of metered fuel, temperature and other, the fuel quantity can be exactly controlled by the recycled exhaust gas over the entire operational range. The temperature factor affects particularly the cold engine and corresponding fuel-air ratios necessary for a trouble-free operation of the engine.

As mentioned before, in the second operational condition of the engine, the exhaust gas return is interrupted inasmuch as in certain operational ranges of the engine the cylinders are supposed to work with lower charge. Especially in idling state a minute gas charging of the cylinders is advantageous for the quiet run of the engine. Moreover, with low cylinder charge the temperature of exhaust gases increases so that soot filter can be burned up. In the second operational condition the solenoid controlled valve 21 is deenergized and control spool 32 is in the position illustrated in FIG. 1. The control pressure chamber 16 is connected to ambient air and is under the same pressure level as the reference pressure chamber 18. As a consequence, movable wall or diaphragm 15 is biased by resetting spring 17 in a position in which the control member 12 at the outlet of return conduit 4 is in its closed position. At the same time, however, control pressure delivered by the pressure transformer 36 is applied to the control pressure chamber 25 of the second setting motor and, at the corresponding modulation of the pressure medium by the circuit 44, adjusts the position of air throttle 11 in accordance with sensed operational variables of the engine applied to the control circuit 44. The adjustment of the air throttle 11 reduces noise in idling operation of the engine. The air throttle acts on the final pressure in the combustion spaces of the engine after compression and produces a vibration-free running. Rotary speed signal can be applied as a verification in a regulating loop for controlling the air throttle 11.

During the second operational condition of the engine when no exhaust gas return occurs, the exhaust gas temperature can be also increased through throttling the engine by air throttle 11 and the increased temperature is also used for burning the soot filter in the exhaust gas collection system. In self-igniting internal combustion engines exhaust gas has a high component of soot and the pores of the filter quickly fill up with separated soot whereby back pressure in the system 3 increases. The soot filters can be either replaced or the accumulated soot can be burned up without the need of any change. The latter method has eviently the advantage of simpler maintenance. By means of air throttle 11 the exhaust gas temperature can be increased during the second operational condition of the engine to such an extent that the accumulated soot burns up. With advantage the burning is effected in the presence of catalytic components of the filter which lower the ignition temperature.

A time factor in the second operational condition or in connection with the increase of backpressure or pressure drop across the filter can be also used as a control parameter provided that the engine has already reached its working temperature.

If the engine is to be stopped then the stoppage can also be made with advantage by the air throttle 11 which is brought in its fully closed position. For this purpose, the directional control valve 21 is deenergized so that control pressure chamber 29 is attacked by pressure from transformer 36. The pressure transformer is also deenergized whereby underpressure or vacuum from pressure space 41 is applied through control valve 21 in the control pressure chamber 25 to the second setting motor, resulting in the closure of the air throttle 11. The same process takes place also when the electronic control circuit 44 is inactivated. This possibility guarantees a reliable stopping of the engine even in the case of a failure. In starting the engine, the vacuum pump 41 is inoperative at this time point and consequently no underpressure is delivered which might close the air throttle.

Figure 2:
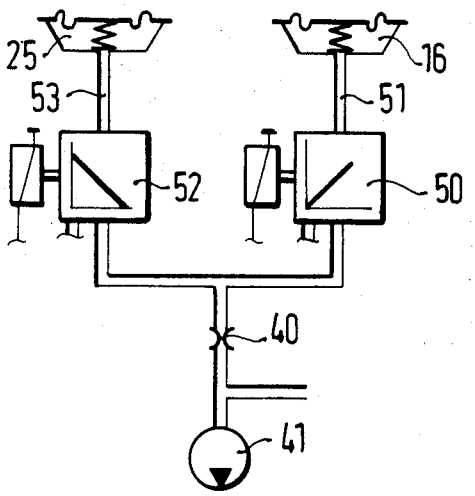
FIG. 2 shows a modification of the device of FIG. 1 employing two pressure transformers each cooperating with an assigned setting motor.

In the embodiment of FIG. 2, there are provided two separate electrically controlled pressure transformers 50 and 52 connected via conduit 51 and 53 to respective control pressure chambers 16 and 25 of the first and second setting motors. The directional control valve 21 is dispensed with. The first input ports of the two pressure transformers are connected via throttle 40 to the first source 41 of underpressure and the second port of each pressure transformer is connected to the second pressure source, namely to ambient air. The pressure transformer 50 is designed such that in its deenergized condition the reference pressure (atmospheric pressure) is admitted through supply conduit 51 in the control pressure chamber 16 of the first setting motor, whereas in the fully energized condition only the underpressure from the source 41 is supplied to the chamber 16. Consequently, when the pressure transformer 60 is deenergized, control member 12 for the returned exhaust gas is brought in its lifted or closing position and the return conduit 4 is interrupted.

The second pressure transformer 52 is designed in such a manner that during its deenergized condition vacuum or underpressure from pressure source 41 is applied through conduit 53 in the control pressure chamber 25 of the second setting motor whereas in fully activated condition only the reference (atmospheric) pressure is supplied into the chamber 25. Accordingly, in the deenergized condition of the adjuster of pressure transformer 62 underpressure in the controlled pressure space 25 of the second setting motor counteracts the biasing spring 26 and sets the air throttle 11 into its fully closed position. In this manner the device performs a safety function in the sense that when the electric control circuit is accidentally inactivated the engine stops.

The solution according to this invention enables the most accurate positioning of the air throttle 11 and of the control member 12 for the returned exhaust gas so as to achieve the desired running behavior, loading and emission behavior of the engine.

Figure 3:
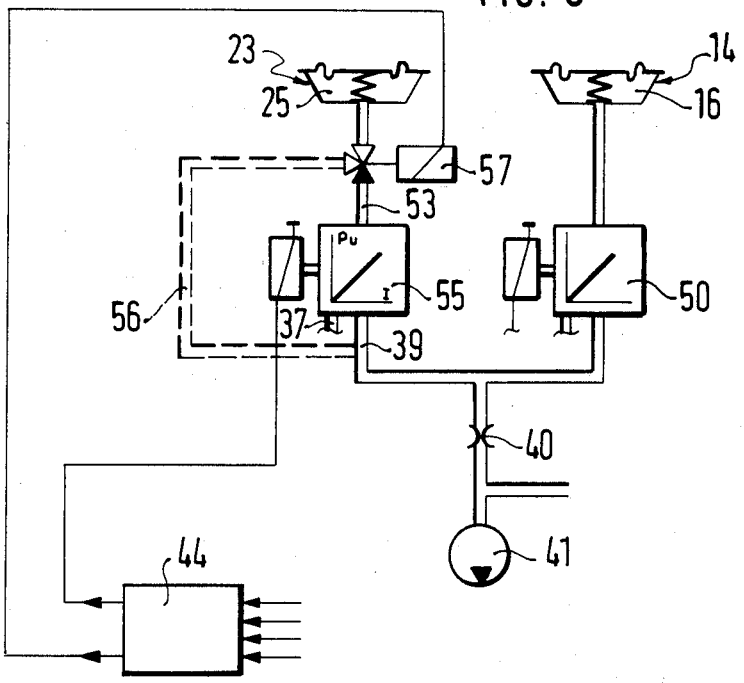
FIG. 3 is a modification of the embodiment of FIG. 2 in which the two pressure transformers in inactive condition deliver a reference pressure.

FIG. 3 illustrates a variation of the embodiment of FIG. 2 employing also two pressure transformers 50 and 55 assigned to respective setting motors 13 and 23. An input in both pressure transformers is connected via throttle 40 to a common source 41 of low pressure or vacuum and another input of respective transformers is connected to ambient air. This embodiment differs from that of FIG. 2 in the construction of the second pressure transformer 55 which is identical with the first pressure transformer 50. It means that when the acuator of the second pressure transformer 55 is deenergized, reference (atmospheric) pressure is supplied into controlled pressure space 25 of the second setting motor 23. This embodiment has the advantage that the two pressure transformers have an identical controlling behavior. In order to stop the engine in the case of a malfunction, the second pressure transformer 55 must have been energized with maximum current of a continuous pulse. To simplify the design and to reduce power requirements, there is provided a bypass conduit 6 leading from the first input conduit 39 to the output conduit 53 and via a 3/2 directional control valve 57 to the control pressure chamber 25. The directional control valve 57 is solenoid controlled whereby in the deenergized condition it connects the conduit 51 directly with the chamber 25 whereas in its energized condition it closes this connection. Therefore, in order to stop the engine the valve 57 is deenergized simultaneously with the transformers and underpressure from the source 41 reaches via the bypass conduit 56 the control pressure chamber 25 and setting motor 23 closes the air throttle 11. Alternatively, the 3/2 valve 27 can be arranged at the connection piece 37 leading to the reference pressure source and to the input conduit 39 so as to connect both inputs 37 and 39 with the first pressure source 41 when deenergized.

Figure 4:
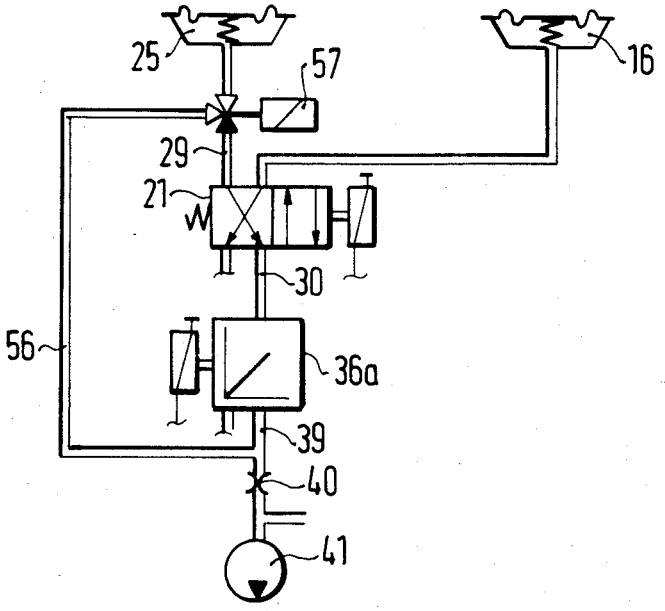
FIGS. 4 and 5 illustrate still other modifications of the device of FIG. 1.

FIG. 4 shows a modification of the embodiment of FIG. 1 employing a single pressure transformer **36*a* which in the energized condition of its actuator supplies reference pressure directly to its output conduit 30 and closes its port to the input conduit 39 leading to the first pressure source 41. In the illustrated deenergized position of the directional control valve 21 and of the actuator of the pressure transformer, ambient pressure is applied directly through conduit 30 and conduit 29 in the control pressure chamber 25 of the second setting motor. When the actuator of the pressure converter 36*a* is energized with a maximum current while position of valve 21 remains unchanged, then underpressure from the first pressure source 31 is supplied in the control pressure chamber 25. Since in order to start the engine the valve 21 must be deenergized in order to assume the illustrated switching position while at the deenergized condition of the pressure transformer 36*a* the underpressure from the first pressure source 21 is shut off, there is provided a bypass conduit 56 leading from the input conduit 39 to the 3/2 directional control valve 57 arranged in the conduit 29 communicating with control pressure chamber 25. In the deenergized condition of the control solenoid of the valve 57 the conduit 29 is opened whereas in the deenergized condition of the valve 57 the conduit 29 is closed. Consequently in an inactive state of the valve 27 underpressure from the first source 31 is supplied directly into the control chamber 25 and the air throttle 11** is brought into its closed position.

Figure 5:
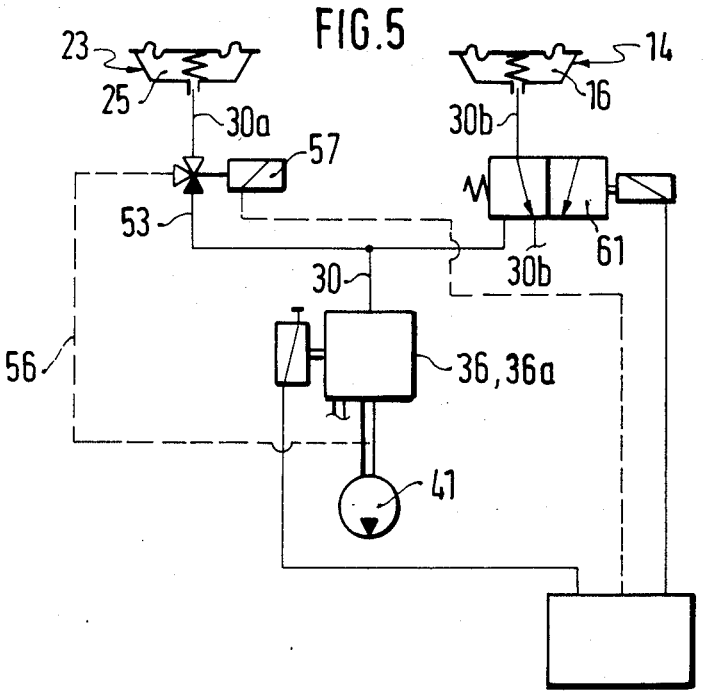

In a further embodiment of this invention illustrated in FIG. 5, there is again employed a single pressure transformer **36*a* supplied with a pressure medium delivered by an underpressure pump 41. Another input of the pressure transformer is again connected to ambient air. In deenergized condition, the pressure transformer applies the reference pressure (ambient pressure) in the output conduit 30. In contrast to the embodiment of FIG. 1, the output conduit 30 leads here in a first branch 30*a* into the control pressure chamber 25 of the second setting motor and via a second branch 30*b* to the control pressure chamber 16 of the first setting motor. An electrically controlled 3/2 directional control valve 61 is arranged in the second branch 30*b*. In the illustrated rest or deenergized position of the valve 61, the control pressure chamber 16 of the first setting motor 14 is connected via a section of the conduit 30*b* with the outer atmosphere and the section of the branch conduit 30*b* leading from the output conduit 30 is closed. When the valve 61 is energized, the connection to ambient pressure is closed and the conduit 30*b*** is opened.

In a first operational mode the solenoid of the valve 61 is activated and pressure in the output conduit 30 of the pressure transformer is delivered both in the control chamber 16 and in the control pressure chamber 25 of the second setting motor 23. That means that with increasing opening of the control member 12 for the returned exhaust gas the free cross-section of the intake tube 9 is closed. In this way it is achieved that pressure gradient across the control member 12 is stabilized and constant conditions for the exhaust gas feedback are achieved. By virtue of the stabilization of the pressure conditions at the control member 12, the control of the returned exhaust gas is simplified and in the case of load variations the feeding of fresh air is affected because simultaneously with the reduction of the quantity of the returned exhaust gas the air throttle is opened. Consequently, in the event of an acceleration any air deficits in the fuel-air mixture fed in the combustion space of the engine is avoided and the sudden emission of soot or smoke is prevented. The device can be constructed with a pressure transformer of conventional design and with a simple and inexpensive 3/2 directional control valve.

The pressure transformer 36a can be identical in design with the pressure transformer of FIG. 4. In order to stop the engine, in the case of a malfunction, this embodiment also provides for a bypass conduit 56 connecting via an electrically controlled 2/2 directional control valve 57 the control pressure space 25 of the second setting motor with the first pressure space 41, thus bypassing the pressure transformer 36a. In energized condition of the adjustor or actuator of the valve 57 the bypass conduit 56 is closed and the pressure transformer communicates via conduit 53 with the control pressure chamber 25. If desired the design of the pressure transformer 36a can be modified similarly as in FIG. 1 so as to apply in its deenergized condition pressure medium from the first pressure source 41 directly to the control pressure chamber 25.

It will be understood that each of the elements described above, or two or more together, may also find a useful application in other types of constructions differing from the types described above. For example, the above described embodiments employ underpressure in the first pressure source and atmospheric pressure in the reference pressure source. By a suitable change in setting motors or by another arrangement of controlled pressure chambers and of the position of presetting springs in the chambers or by a modification of linkage between the setting motor and the air throttle, all these embodiments can be operated by means of overpressure in the first pressure source. In this case, the chambers 18 and 27 in respective setting motors are connected by conduit 19 and 29 to the source of overpressure, whereas chambers 16 and 25 communicate with ambient air.

The illustrated and described embodiments are not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A device for controlling the supply of gases including air and recycled exhaust gas components into a combustion space of a self-igniting internal combustion engine, comprising an air intake system, an exhaust gas collection system, an exhaust gas return conduit communicating with the air intake system; a control member arranged between the exhaust gas return conduit and the air intake system, the control member being arranged for controlling communication between said return conduit and said air intake system, a first pressure activated setting motor including a control pressure chamber, a reference pressure chamber and a movable wall therebetween, said movable wall being connected to said control member, a first source of pressure and a second source of reference pressure, an electrically activated pressure transformer having input ports connectable respectively to said first and a second pressure sources and an output port providing a control pressure formed from said first and second pressure sources and being connectable by connecting means to said control pressure chamber, an electric control circuit for generating a control signal correspondidng to operational variables of the engine, particularly to a sucked in quantity of air and to a supplied quantity of fuel, the control signal controlling the actuation of said pressure transformer, said air intake system including an air throttle normally biased into open position to freely pass fresh air into the engine, a second pressure activated setting motor including a control presence chamber, a reference pressure chamber and a movable wall therebetween, the movable wall of the second setting motor being linked to said air throttle, the control pressure chamber of said second setting motor being connectable by connecting means to the output port of said electrically activated pressure transformer which output port being connectable to said control pressure chamber of said first setting motor, said pressure transformer including two electrically controlled pressure transforming units each having an input connected to said first pressure source and another input connected to said second pressure source, an output of one pressure transforming unit being connected to the pressure control chamber of said first setting motor and an output of the other pressure transforming unit being connected to the pressure control chamber of the second setting motor, said electric control circuit being connected to said connecting means via said electrically controlled pressure transforming units to apply pressure into the control chambers of respective setting motors in such a manner that in one operational condition of the engine during which exhaust gas is recycled the control pressure chamber of the second setting motor is supplied with reference pressure from said second pressure source an the control pressure chamber of the first setting motor is supplied via the output of said one pressure transforming unit with control pressure, and in another operation condition of the engine the control pressure chamber of the first setting motor is supplied with reference pressure from the said second pressure source and the control pressure chamber of the second setting motor is supplied via the output port of said other pressure transforming unit with control pressure.

2. A controlling device as defined in claim 1, wherein one of the pressure transforming units when deenergized, connects control pressure chamber of said first setting motor with said second pressure source, and when energized, with said first pressure source.

3. A controlling device as defined in claim 2, wherein the other pressure transforming unit when deenergized, connects the control pressure chamber of said second setting motor with said first pressure source and when energized with said second pressure source.

4. A controlling device as defined in claim 2, wherein the other pressure transforming unit when deenergized, connects the control pressure chamber of said second setting motor with said second pressure source, and when energized with the first pressure source, and further comprising a bypass conduit connecting said first pressure source with the control pressure chamber of said second setting motor, and said connecting means including an electrically controlled 3/2 directional control valve which in deenergized condition is open and in energized condition is closed.

5. A method of controlling supply of gas including air and returned exhaust gas components, into a combustion space of a self-igniting internal combustion engine, comprising the steps of supplying, in a first operational condition of the engine, an unthrottled quantity of sucked-in air and a controlled quantity of returned exhaust gas component to a quantity of fuel to be injected into the combustion space whereby the quantity of supplied exhaust gas component is pneumatically controlled in dependency on said quantity of fuel such as to match for optimum combustion the supplied air with the supplied fuel and, in a second operational condition of the engine supplying to a quantity of fuel to be injected into a controlled quantity of air while interrupting the supply of the exhaust gas component whereby the supplied air is pneumatically throttled in dependency on operational variables of the engine.

6. A method as defined in claim 5, further comprising the step of collecting soot from exhaust gas, and controlling the throttling in dependency on the temperature of exhaust gases so as to burn the collected soot.

7. A method as defined in claim 5, wherein said throttling is controlled in dependency on emission behavior of the engine.

8. A method as defined in claim 5, wherein the amount of sucked in air is throttled to such an extent as to stop the engine.

9. A method as defined in claim 5, wherein the pneumatic control of the returned exhaust gas component and of the sucked in air is performed by pressure transforming means operating with a source of reference pressure and a source of controlled pressure, the pressure transforming means being electrically controlled in such a manner that when deenergized the return of the exhaust gas component is cut off and the supply of sucked-in air is unthrottled.

10. A method as defined in claim 9, wherein in the running condition of the engine the supply of sucked in air is closed.

11. A device for controlling the supply of gases including air and recycled exhaust gas components into a combustion space of a self-igniting internal combustion engine, comprising an air intake system, an exhaust gas collection system, an exhaust gas return conduit communicating with the air intake system; a control member arranged between the exhaust gas return conduit and the air intake system, the control member being arranged for controlling communication between said return conduit and said air intake system, a first pressure activated setting motor including a control pressure chamber, a reference pressure chamber and a movable wall therebetween, said movable wall being connected to said control member, a first source of pressure and a second source of reference pressure, an electrically activated pressure transformer having input ports connectable respectively to said first and a second pressure sources and an output port providing a control pressure formed from said first and second pressure sources and being connectable by connecting means to said control pressure chamber an electric control circuit for generating a control signal corresponding to operational variables of the engine, particularly to a sucked in quantity of air and to a supplied quantity of fuel, the control signal controlling the actuation of said pressure transformer, said air intake system including an air throttle normally biased into open position to freely pass fresh air into the engine, a second pressure activated setting motor including a control pressure chamber, a reference pressure chamber and a movable wall therebetween, the movable wall of the second setting motor being liked to said air throttle, the control pressure chamber of said second setting motor being connectable by connecting means to the output port of said electrically activated pressure transformer which output port being connectable to said control pressure chamber of said first setting motor, said pressure transformer including a single electrically controlled pressure transforming unit and said connecting means including an electrically controlled directional control valve having a first port connected to the output port of said pressure transforming unit, a second port connected to said reference pressure source, a third port connected to said control pressure chamber of the first setting motor and a fourth port connected to the control pressure chamber of said second setting motor to selectively connect one of said control pressure chambers to said output port of said pressure transforming unit, said electric control circuit being connected to said connecting means and to said electrically controlled pressure transformer to apply pressure into the control chambers of respective setting motors in such a manner that in one operational condition of the engine during which exhaust gas is recycled the control pressure chamber of the second setting motor is supplied with reference pressure from said second pressure source and the control pressure chamber of the first setting motor is supplied via said output port of said pressure transforming unit with control pressure, and in another operational condition of the control pressure chamber of the first setting motor is supplied with reference pressure from the said second pressure source and the control pressure chamber of the second setting motor is supplied via said output port of said pressure transforming unit with control pressure.

12. A controlling device as defined in claim 11, wherein said electrically controlled directional control valve in deenergized condition thereof connects the control pressure chamber of the first setting motor with the reference pressure source.

13. A controlling device as defined in claim 11, further comprising means for changing pressure supplied from the said pressure transformer into the control pressure chamber of the first setting motor in such a manner that according to an adjustable fuel-air ratio the gaseous components applied to combustion spaces of the engine provide residual charge of the combustion space with an amount of returned exhaust gas.

14. A controlling device as defied in claim 11, wherein said single pressure transforming unit has an input connected to said first pressure source and another input connected to said second pressure source, and an output branching to respective control pressure chambers of said setting motors, said connecting means including an electrically controlled 3/2 directional control valve connected in a branch leading to control pressure chamber of said first setting motor to connect the same in one position with the outer atmosphere and in another position with the output of said pressure transforming unit.

15. A controlling device as defined in claim 14, wherein said electrically controlled directional control valve in deenergized condition thereof connects the control pressure chamber of the first setting motor with the reference pressure source.

16. A controlling device as defined in claim 11, wherein said first pressure sourced is a pneumatic underpressure source.

17. A controlling device as defined in claim 16, wherein said first pressure source is a pneumatic pump driven by the engine.

18. A controlling device as defined in claim 11, wherein in the second operational condition of the engine the electric control circuit controls said connecting means and said pressure transformer in such manner that control pressure chamber of the first setting motor is exposed to reference pressure and the control chamber of the second setting motor is exposed to the control pressure from the said pressure transformer, said air throttle is adjusted to a position in which said air intake system is throttled in order to produce low noise during idling of the engine and at a low engine load while a desired fuel-air ratio is maintained.

19. A controlling device as defined in claim 18, wherein said exhaust gas collection system includes means for collecting soot contained in exhaust gas, and further comprising means for adjusting the air throttle during the second mode of operation of the engine into a position in which throttling occurs whereby temperature of the exhaust gases is raised to a level at which soot collected in said collecting means is burned.

20. A controlling device as defined in claim 19, wherein said means for adjusting the position of said air throttle are controlled in dependence on characteristic values of said exhaust gas collection system and on operational variables of the engine.

21. A controlling device as defined in claim 19, wherein in an inoperative condition of said electric control circuit the engine is brought in its second operational condition and the control pressure chamber of the second setting motor is supplied with pressure from the first pressure source.

* * * * *